US005664812A

United States Patent [19]

Marinoni

[11] Patent Number: 5,664,812

[45] Date of Patent: Sep. 9, 1997

[54] MECHANISM FOR LOCKING A DOOR OR DOOR LEAF TO THE FLOOR

[75] Inventor: Mario Marinoni, Magenta, Italy

[73] Assignee: Societa Italiana Progetti S.R.L., Italy

[21] Appl. No.: 596,327

[22] PCT Filed: Aug. 16, 1994

[86] PCT No.: PCT/EP94/02731

§ 371 Date: May 21, 1996

§ 102(e) Date: May 21, 1996

[87] PCT Pub. No.: WO95/05517

PCT Pub. Date: Feb. 23, 1995

[30] Foreign Application Priority Data

Aug. 17, 1993 [DE] Germany ..... 93 12 291.8 U

[51] Int. Cl.[6] ..... E05C 1/04

[52] U.S. Cl. ..... 292/153; 292/DIG. 15

[58] Field of Search ..... 292/175, DIG. 15, 292/338, 153

[56] References Cited

U.S. PATENT DOCUMENTS

| | | | |
|---|---|---|---|
| 357,116 | 2/1887 | Coultaus | 292/153 X |
| 423,109 | 3/1890 | Austermuhl Jr. | 292/153 |
| 776,946 | 12/1904 | Ruppman | 292/153 |
| 1,287,080 | 12/1918 | Newman | 292/153 X |
| 1,436,892 | 11/1922 | Morse et al. . | |
| 2,065,615 | 12/1936 | Schlage | 292/175 |
| 3,239,261 | 3/1966 | Byson et al. | 292/75 |
| 4,050,723 | 9/1977 | Papadatos | 292/DIG. 15 X |

FOREIGN PATENT DOCUMENTS

| | | |
|---|---|---|
| 1522466 | 3/1968 | France . |
| 342466 | 10/1921 | Germany . |
| 3100422 | 9/1982 | Germany . |

*Primary Examiner*—Rodney M. Lindsey

*Attorney, Agent, or Firm*—Beveridge, DeGrandi, Weilacher & Young, L.L.P.

[57] ABSTRACT

The invention relates to a mechanism for locking a door (2) or door leaf to the floor by means of a vertically displaceable latch (3) mounted to the bottom of the inner surface (6) of the door (2) or door leaf In order to prevent burglars from unlocking the latch (3) from outside, the latch (3) is fixed to a slide block (16) bearing a mounting pin (20) for an operating handle projecting inwardly, the mounting pin (20) being pivotable in a limited range about a horizontal first pivot axle arranged parallel to the door or door leaf; the slide block (16) further bearing an bell crank lever (26) pivotable about a horizontal pivot axle (24) disposed perpendicular to the door (2) or door leaf; a first arm of the bell crank lever (26) extending beyond the mounting pin (20) and being biased downwardly by a spring (30), while the other arm extends downward and is provided with a hook oriented laterally for releasably engaging a latch recess in the housing (14).

7 Claims, 2 Drawing Sheets

MECHANISM FOR LOCKING A DOOR OR DOOR LEAF TO THE FLOOR

Figure 1:
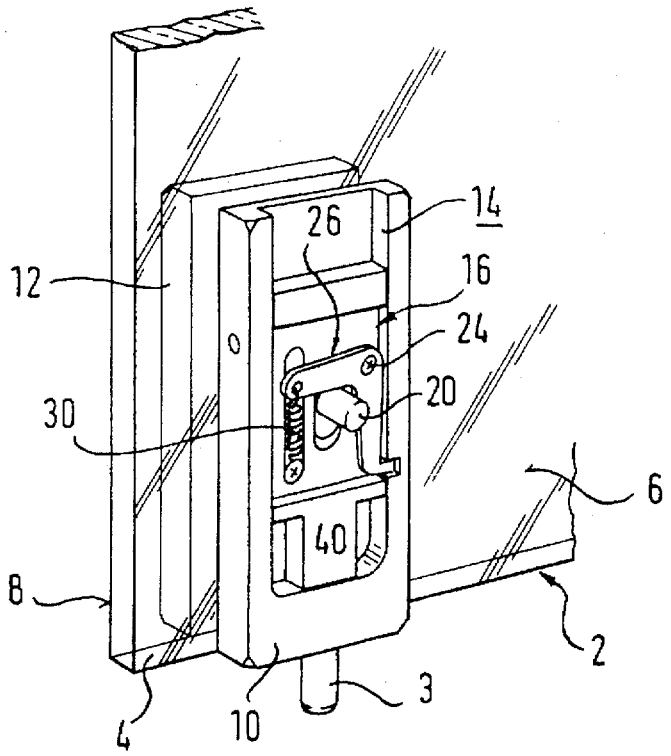

The invention relates to a mechanism for locking a door or door leaf made of glass—in particular prestressed glass—by means of a vertically displaceable latch disposed in a housing mounted to the bottom of the inner surface of the door or door leaf.

Such a mechanism for locking a door is known from the U.S. Pat. No. 1,436,892.

In particular doors and door leaves made of prestressed glass necessitate spaces (air gaps) between their lower edges and the floor. A burglar can insert a tool from outside into such a space in order to lift the latch and, thus, to unlock the door or door leaf.

Prior art designs to avoid this risk require a rotatable operating handle or expensive construction.

It is an object of the invention to provide a mechanism of the type mentioned above which rules out unlocking from outside by a burglar, or renders such unlocking extremely difficult, while being easy to operate and simple in design.

To achieve this object, the mechanism is characterised in that the latch (3) is fixed to a slide block (16) vertically displaceable in the housing (14), the slide block (16) bearing a mounting pin (20) for an operating handle (22) projecting inwardly, the mounting pin (20) being pivotable in a limited range about a horizontal first pivot axle (18) arranged parallel to the door or door leaf, that the slide block (16) further bears an bell crank lever (26) pivotable about a horizontal pivot axle (24) disposed perpendicular to the door (2) or door leaf, a first arm (28) of the bell crank lever (26) extending beyond the mounting pin (20) and being biased downwardly by a spring (30), while the other arm (32) extends downward and is provided with a hook (34) oriented laterally for releasably engaging a latch recess (36) in the housing (14), the bell crank lever (26) being so arranged that, in operation, upon lifting the mounting pin (20) in order to raise the latch (3) from its locking position, the resultant pivoting of the mounting pin causes the bell crank lever to pivot, thereby releasing the hook (34) from the latch recess (36).

In the design according to the invention, the latch can be unlocked by simple linear lifting of the operating handle, and locked accordingly by simple linear lowering of the operating handle. In the locked state, the latch is positively held by the hook engaging the latch recess and cannot be raised from outside, resulting in a safety lock arrangement.

In order to allow the mounting pin of the operating handle to extend horizontally in the locked state, the mechanism is preferably characterised in that the mounting pin extends from a central or lower portion of a vertically elongate base member, the upper part of which is pivotable about the first pivot axle. In order keep the mechanism compact, it is preferably characterised in that the slide block is formed with cavities for receiving the bell crank lever, the spring and/or the base member.

The invention will be explained in conjunction with an exemplary embodiment making reference to the accompanying drawings.

Figure 2:
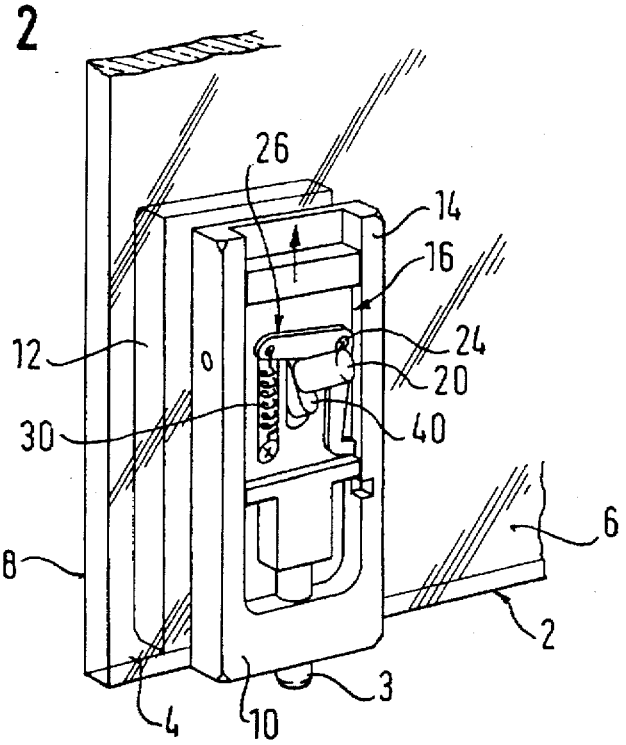
Figure 3:
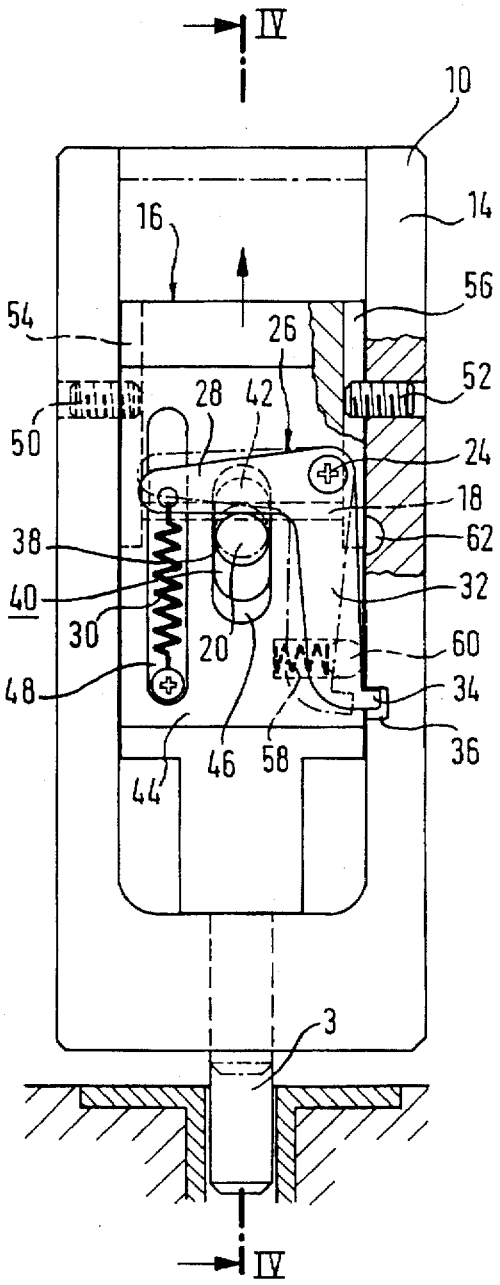
Figure 4:
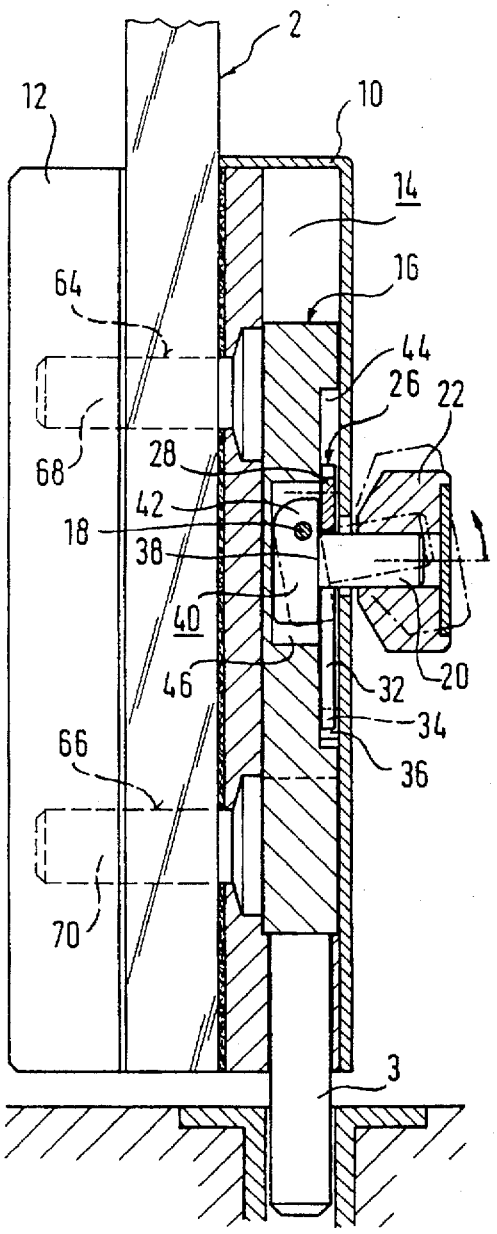

FIG. 1 is a perspective view of the mechanism in the locked state, with its front side open, FIG. 2 shows the mechanism of FIG. 1 in the unlocked state (or during unlocking), FIG. 3 is a detailed front view of the mechanism, and FIG. 4 is a sectional view taken along line IV—IV in FIG. 3.

The mechanism of the exemplary embodiment serves to lock a door 2 (or door leaf) made of prestressed glass to the floor. Adjacent to a lower edge 4 of door 2, cheek plates 10, 12 are attached to the inner surface 6 and outer surface 8 of the door, and coupled to each other by screws 68, 70 penetrating holes 64, 66 formed in door 2. The inner cheek plate 10 confines a housing 14 for a slide block 16. The slide block 16 bears a mounting pin 20 for an operating handle 22 projecting inwardly, the mounting pin 20 being pivotable in a limited range about a horizontal first pivot axle 18 arranged parallel to the door. The slide block 16 further bears a bell crank lever 26 pivotable about a horizontal pivot axle 24 disposed perpendicular to door 2; a first arm 28 of the bell crank lever 26 extends beyond the mounting pin 20 and is biased downwardly by a spring 30, while the other arm 32 extends downward and is provided with a hook 34 oriented laterally for releasably engaging a latch recess 36 in housing 14.

The mounting pin 20 extends from a central portion 38 of a vertically elongate base member 10, the upper part 42 of which is pivotable about the first pivot axle 18.

The slide block 16 is formed with cavities 44, 46, 48 for receiving the bell crank lever 26, spring 30 and base member 40.

The upward path of travel of slide block 16 is limited by headless screws 50, 52 penetrating the housing 14 to engage lateral longitudinal grooves 54, 56 of slide block 16.

In order to latch the slide block 16 in its raised position, the slide block 16 comprises a ball 60 biased by a spring 58 and arranged to be pushed substantially horizontally and laterally into a corresponding spring latch recess 62 in housing 14.

I claim:

1. A locking mechanism, comprising:

a housing member having a cavity defined therein, a peripheral wall of said cavity having a latch recess defined therein;

a slide block received in said cavity of said housing and being slidable along a first axis;

a latch fixed to said slide block;

a mounting pin pivotally coupled to said slide block about a first pivot axis;

an operating handle engaging said mounting pin;

a bell crank lever pivotally coupled to said slide block about a second pivot axis substantially perpendicular to said first pivot axis, said bell crank having a first arm and a second arm, said first arm extending beyond said mounting pin, said second arm extending in a direction parallel with said first axis and having a hook laterally extending therefrom, said hook releasably engaging said latch recess; and a spring biasing said first arm of said bell crank lever in a direction parallel with said first axis, wherein said bell crank lever is arranged such than, when said mounting pin is pivoted during operation, said bell crank lever pivots and releases said hook from said latch recess, thereby permitting said slide block and said latch to move along said first axis and relative to said housing member.

2. The locking mechanism as defined in claim 1, wherein:

said mounting pin includes an elongated base member, an upper part of said elongated base member being pivotally coupled to said slide block.

3. The locking mechanism as defined by claim 2, wherein:

said slide block has a cavity defined therein for receiving said base member.

4. The locking mechanism as defined by claim 3, wherein:

said first axis is substantially vertical.

5. The locking mechanism as defined by claim 1, wherein:

said slide block has a cavity defined therein for receiving said bell crank lever.

6. The locking mechanism as defined by claim 1, wherein:

said slide block has a cavity defined therein for receiving said spring.

7. The locking mechanism as defined by claim 1, wherein:

said first axis is substantially vertical.

* * * * *